US007572110B2

(12) United States Patent
Bernard et al.

(10) Patent No.: US 7,572,110 B2
(45) Date of Patent: Aug. 11, 2009

(54) PUMPING APPARATUS USING THERMAL TRANSPIRATION MICROPUMPS

(75) Inventors: Roland Bernard, Viuz-la-Chiesaz (FR); Hisanori Kambara, Villy-le-Pelloux (FR)

(73) Assignee: Alcatel, Paris (FR)

( * ) Notice: Subject to any disclaimer, the term of this patent is extended or adjusted under 35 U.S.C. 154(b) by 494 days.

(21) Appl. No.: 10/979,149

(22) Filed: Nov. 3, 2004

(65) Prior Publication Data

US 2005/0095143 A1 May 5, 2005

(30) Foreign Application Priority Data

Nov. 4, 2003 (FR) ..... 03 12894

(51) Int. Cl.
*F04B 3/00* (2006.01)
*F04B 5/01* (2006.01)

(52) U.S. Cl. ..... 417/244; 417/207; 417/208; 417/410.1; 219/209; 219/210

(58) Field of Classification Search ..... 417/207, 417/208, 410.1, 244; 219/209–210, 483–486; 307/38–41; 422/221
See application file for complete search history.

(56) References Cited

U.S. PATENT DOCUMENTS

| | | | | |
|---|---|---|---|---|
| 5,041,800 | A * | 8/1991 | Long et al. | 331/69 |
| 5,541,629 | A * | 7/1996 | Saunders et al. | 347/12 |
| 5,871,336 | A * | 2/1999 | Young | 417/207 |
| 6,422,823 | B2 * | 7/2002 | Bernard et al. | 417/18 |
| 6,533,554 | B1 * | 3/2003 | Vargo et al. | 417/207 |
| 2002/0076140 | A1 * | 6/2002 | Kobrin | 385/18 |
| 2004/0151598 | A1 * | 8/2004 | Young et al. | 417/208 |

* cited by examiner

*Primary Examiner*—Devon C Kramer
*Assistant Examiner*—Patrick Hamo
(74) *Attorney, Agent, or Firm*—Sughrue Mion, PLLC

(57) ABSTRACT

Pumping apparatus of the invention using thermal transpiration micropumps comprises a plurality of individual thermal transpiration micropumps distributed over a substrate (5) as a plurality of rows (A, B, C, . . . , D) each made up of a plurality of micropumps (1, 6, . . . , 7, 8, 9), thereby building up a plurality of columns (a, b, . . . , c, d). Respective heater elements (4) in each of the thermal transpiration micropumps are controlled by suitably controlling a row control conductor (10A) and a column control conductor (11*a*). This greatly simplifies multiplexed control of a large number of individual micropumps, thus enabling pumping capacity to be adapted.

11 Claims, 5 Drawing Sheets

PUMPING APPARATUS USING THERMAL TRANSPIRATION MICROPUMPS

The present invention relates to pumping apparatuses using thermal transpiration micropumps that enable low gas pressures to be generated and maintained in enclosures of small volume.

In the semiconductor industry, for example, systems for handling substrates are presently used for isolating such substrates and preventing them from coming into contact with contaminating the agents that are still present in white rooms, even if only in small quantities. Proposals have been made to place each substrate in a container whose inside atmosphere is maintained at low pressure by a micropump, thus providing a portable self-contained assembly.

Such micropumps must be of very small size, and they must present capacity suitable for generating a vacuum, or at least for maintaining a vacuum. In other words, they must be capable of producing a sufficient compression ratio and a sufficient gas flow rate.

One proposal for such micropumps has been to use an array of micropumps operating by the thermal transpiration effect.

In the thermal transpiration effect, as was shown by Knudsen in the 1900s, when two large volumes are interconnected by a channel of very small cross-section, of radius smaller than the mean free path length of the gas molecules present, and when the ends of the channel are at different temperatures, then a pressure difference is established between the two large volumes. In the small-sized channel, molecules move under molecular conditions, and as a result the pressures differ at the two ends of the channel because of the temperature difference. Under molecular conditions, when thermal equilibrium is reached, then the pressures at the two ends of the channel are such that the ratio is equal to the square root of the ratio of the corresponding temperatures.

When the molecules reach the large volume adjacent to the hot end of the channel, their travel no longer occurs under molecular conditions, but occurs under viscous medium conditions. As a result, at the hot end of the channel, the molecules escape from the channel and penetrate into the adjacent large volume, and they do not return into the channel. This produces a pumping effect with a compression ratio that can be as great as the square root of the temperature ratio.

It is known that a significant compression ratio can be achieved by connecting a large number of thermal transpiration micropump stages in series. In theory, the total compression ratio of N stages is the product of the N individual compression ratios.

Such micropumps require channels to be made having dimensions that are small enough to be compatible with the mean free path length of the gas molecules that are to be compressed. The mean free path length of the molecules increases with decreasing pressure, so it will be understood that the channels can be of larger dimensions when the pressure inside the pump is low. In the range of pressures that are to be found in the semiconductor industry while handling substrates, the mean free path length of molecules is of the order of a few micrometers. It is then possible to make channels of satisfactory dimensions using microelectronic mechanical systems (MEMS) technology. The channels and the cavities can be made by deep etching in the surface of a semiconductor wafer. The cavities are then closed by a glass plate applied in leaktight manner to the surface of the semiconductor wafer.

However, several problems are encountered when seeking to obtain compression ratios and flow rates that are sufficient and compatible with the intended applications. To do that, it is necessary to combine a large number of thermal transpiration micropumps in series with one another, and to power them electrically in order to heat one of the ends of each of the channels interconnecting successive cavities. However, it is necessary to be able to adapt pumping capacities as a function of conditions of use.

In this respect, and conventionally, the pressure in a chamber or an enclosure of the mini-environment is controlled by providing a mechanical regulator valve at the inlet to the pump, in order to match the conductance of the pipe to the pumping conditions that are to be obtained. That structure suffers from the drawback of adding an element to the system, and the moving mechanical parts making up the valve can generate harmful contamination because of friction between the mechanical parts.

A pumping apparatus using thermal transpiration micropumps thus makes it possible to avoid those drawbacks, providing it is possible to control the pumping capacities of the apparatus.

A first problem is then that of powering and controlling the individual thermal transpiration micropump cells in a manner that is both simple and effective so as to enable their pumping capacities to be controlled without adding a regulator valve.

Multiplying the number of individual micropumps that are connected together in the apparatus requires special control means enabling the set of individual micropumps to be managed easily.

For this purpose, the invention seeks to provide control that is particularly simple and effective for apparatus made up of a large number of micropumps, in order to enable the overall pumping function of the individual micropumps to be controlled without adding a regulator valve.

It is necessary to control both the flow rate of the micropumps, and the compression ratio of the apparatus, so as to control the pressure of a mini-environment to which the pumping apparatus is connected.

A second problem is associated with providing the hot source at one of the ends of each of the channels interconnecting two successive cavities. It will be understood that the compression ratio is directly related to the effectiveness of the hot source which determines the temperature ratio between the two ends of the channel.

In a usual configuration, the hot source of a thermal transpiration micropump is made by integrating, in the top glass plate, a heater element in the form of a rectangular bar of resistive material, constituting an electrical resistance that can be powered from an external source of energy.

The problem is that in order to obtain an appropriate temperature at the inlet to the channel, i.e. at the frontier with the adjacent cavity of the micropump, the bar-shaped heater element delivers a temperature that is clearly higher in the central zone of the bar, since temperature decreases on going towards the end of the bar which is adjacent to the inlet of the channel.

This results not only in an excessive consumption of energy, but also in a risk of degrading materials in the vicinity of the central zone of the heater element.

Conversely, if it is desired to reduce the risk of degradation in the central zone of the heater element, then the temperature of the hot source at the frontier between the channel and the adjacent cavity of the micropumps is insufficient, and the effectiveness of the pump is decreased.

Another aspect of the invention is thus to increase the effectiveness of the micropumps while reducing the risk of degradation due to an excessively high temperature in the central zones of the hot sources of the micropumps.

Simultaneously, in this other aspect, the invention seeks to achieve optimum effectiveness of the micropump while reducing its energy consumption.

A third problem is that the necessary multiplication in the number of individual micropumps leads to a proportional increase in the total volume occupied by the pumping apparatus.

With cavities that are of rectangular shape, such as those that have been used until now, the total volume of the pumping apparatus can become excessive compared with the space available in the intended applications.

In another aspect, the invention thus seeks to reduce the overall volume of the pumping apparatus for a given number of individual thermal transpiration micropumps.

In order to control a pumping apparatus having a large number of individual thermal transpiration micropumps in a manner that is simple and effective, the invention provides pumping apparatus using thermal transpiration micropumps, in which:

each thermal transpiration micropump comprises at least one cavity having an inlet connected to an inlet channel of small cross-section and having an outlet connected to an outlet channel, and including a heater element for heating the segment of the inlet channel that is adjacent to the cavity, a plurality of such micropumps being connected in series;

the micropumps are distributed on a substrate in a plurality of rows each made up of a plurality of micropumps, thereby building up a plurality of columns; and the respective heater elements of the micropumps are each controlled by appropriately controlling a row control conductor and a column control conductor.

In practice, provision can be made for the row control conductors to be accessible for electrical connection along a first edge of the substrate, and for the column control conductors to be accessible for electrical connection along a second edge of the substrate.

Because of this matrix disposition of the individual micropumps, it is possible, advantageously, to provide control means which selectively control the row control conductors and the column control conductors in such a manner as to control each individual micropump of the array of micropumps individually.

Various interface circuits may be used between the row control conductors and the column control conductors in order to power in individual manner a heater element of the micropump placed at the intersection between the row and the column.

For example, when each heater element is of the electrical resistance type, the heater element may be connected to the terminals of an electrical power supply in series with a transistor, itself controlled by an AND gate having its inputs connected respectively to a corresponding row control conductor and to a corresponding column control conductor. Powering the row control conductor simultaneously with the column control conductor serves to switch ON the transistor in order to power the heater element.

Alternatively, each heater element can advantageously be controlled by a bistable, itself arranged to change state on simultaneously receiving control pulse signals coming from a corresponding row control conductor and from a corresponding column control conductor.

In order to obtain a high compression ratio, all of the individual micropumps can be connected in series one after another.

Nevertheless, it can be advantageous to obtain simultaneously a volume flow rate that is sufficient. Under such circumstances, provision can be made for one or more rows of micropumps to be connected in series so as to constitute a series subassembly, with a plurality of series subassemblies being connected in parallel.

In order to increase the effectiveness of the individual micropumps while reducing the risk of thermal degradation, and while reducing energy consumption, pumping apparatus of the invention may use individual thermal transpiration micropumps in which the heater element is arranged to avoid overheating certain zones of the channel segment that is to be heated by achieving a substantially uniform distribution of temperature along the length of the channel segment that is to be heated.

In practice, provision can be made for at least some of the micropumps to have a heater element arranged to distribute heating evenly along the length of the channel segment that is to be heated so as to achieve a distribution of temperature that is substantially regular along the length of the channel segment that is to be heated.

In a first embodiment, the heater element is of the electrical resistance type and comprises at least two electrically conducive zones placed in two successive zones that are longitudinally spaced apart from each other along the channel segment that is to be heated.

In a second embodiment, the heater element of the electrical resistance type is a resistive area including a central hole.

In a third embodiment, the heater element is of the electrical resistance type in the form of a heater track wound as a flat double spiral.

Alternatively, or in addition to the above embodiments, the heater element may advantageously be the heating zone of a Peltier effect element.

In order to solve the third problem, i.e. in order to reduce the total volume of the pumping apparatus using thermal transpiration micropumps, the invention proposes increasing the extent to which the cavities are integrated.

A first idea then consists in giving the cavities a shape that is easier to integrate, and in placing the cavities relative to one another in such a manner as to reduce their total overall size.

Integration may initially be horizontal, in the form of a plurality of rows of micropumps side by side.

Integration may alternatively, or in addition, take place vertically, by having a plurality of layers of individual micropumps.

Thus, in the pumping apparatus, the invention proposes making provision for at least some of the micropumps to have a cavity of section that tapers going from its inlet towards its outlet, and by making provision for cavities of similar shape to be interleaved in opposite directions so as to reduce the total space they occupy in common in cross-section.

With such cavities of varying section, it is nevertheless necessary to ensure that the cross-section of the cavity, at its inlet, is large enough to enable gas molecules to cease moving under molecular type conditions at the high temperature produced by the adjacent heater element, and then adopt viscous medium movement conditions, and it is necessary simultaneously to ensure that the molecules continue moving under viscous medium travel conditions at the other end of the cavity where its section is smaller but its temperature is lower. The invention thus takes advantage of the progressive shortening of the mean free path length of molecules when temperature decreases from the inlet towards the outlet of the cavity, and reduces the cross-section of the cavity accordingly, taking care that the cross-section of the cavity at all points along the length thereof remains large enough for the gas molecules to travel under viscous medium conditions.

In a first embodiment, the cavities are of constant thickness and of width that tapers going from their inlets to their outlets, and the cavities are interleaved side by side facing in opposite directions so as to reduce their overall size in the transverse direction.

Alternatively, or additionally, the cavities may be of thickness that decreases going from their inlet towards their outlet.

Multilayer integration can be performed by providing for a substrate wafer to be processed on both faces so as to make two layers of cavities.

Preferably, provision is then made for two layers of cavities to have thicknesses which decrease going from their inlet towards their outlet, and for the cavities to be interleaved in opposite directions in the thickness of the substrate.

It will be understood that the particular control means for achieving simple and effective control of a large number of micropumps constitute a first invention that can be used either in combination with or independently of the other means described in the present patent application.

Similarly, the means seeking to increase the effectiveness of the micropumps by reducing the risk of thermal degradation constitute a second invention that can be used either in combination with or else independently of the other means described in the present patent application.

Finally, the means seeking to reduce the total volume of the pumping apparatus constitute a third invention that can be used either in combination with or else independently of the other means described in the present patent application.

Other objects, characteristics, and advantages of the present invention appear from the following description of particular embodiments, given with reference to the accompanying figures, in which.

Figure 1:
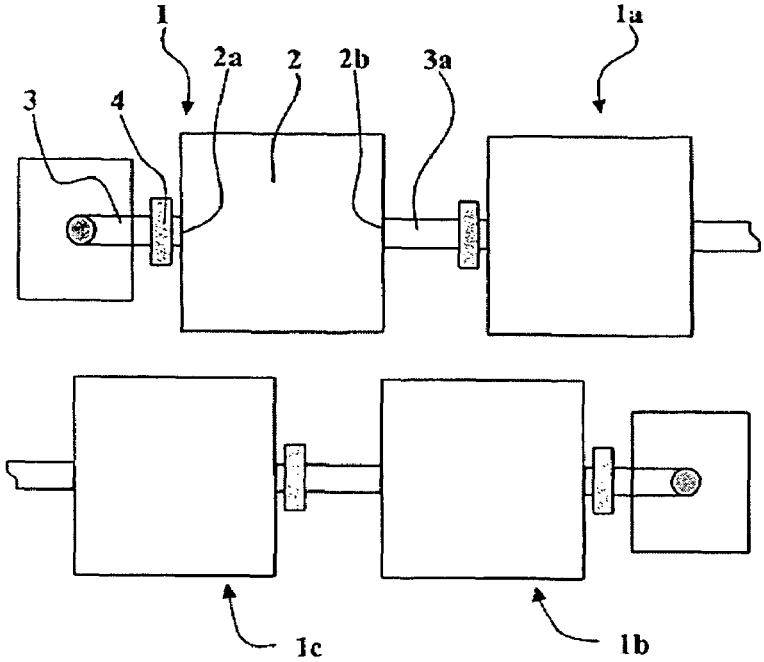
FIG. 1 shows four individual thermal transpiration micropumps.

FIG. 1 shows four individual micropumps given respective numerical references 1, 1*a*, 1*b*, and 1*c*, each micropump being constituted in the same manner as the micropump 1, of a cavity 2, of a channel 3, and of a heater element 4 disposed in contact with the channel 3 in the vicinity of its connection to the cavity 2.

The channel 3 constitutes the inlet channel of the individual micropump 1, and it is connected to the inlet 2*a* of the cavity 2.

The cavity 2 has an outlet 2*b* which is connected to an outlet channel 3*a*, itself constituting the inlet channel of the second individual micropump la.

The cross-section of the inlet channel 3 is small enough for gas molecules that travel therealong to move under molecular conditions. In contrast, the cavity 2 presents a cross-section that is large enough for the molecules it contains to travel under viscous medium conditions.

At the low pressures at which thermal transpiration micropumps are intended to operate, the channel needs to have a section of the order of a few micrometers. The cavity 2 may have a cross-section of a few tens of micrometers. Such shapes can be made in a semiconductor substrate by etching, and then by closing the substrate by means of a plate of glass that is pressed against the etched substrate.

The heater element 4 may be constituted by a deposit of silicon nitrate with thermal oxidation, implemented on the glass plate.

Figure 2:
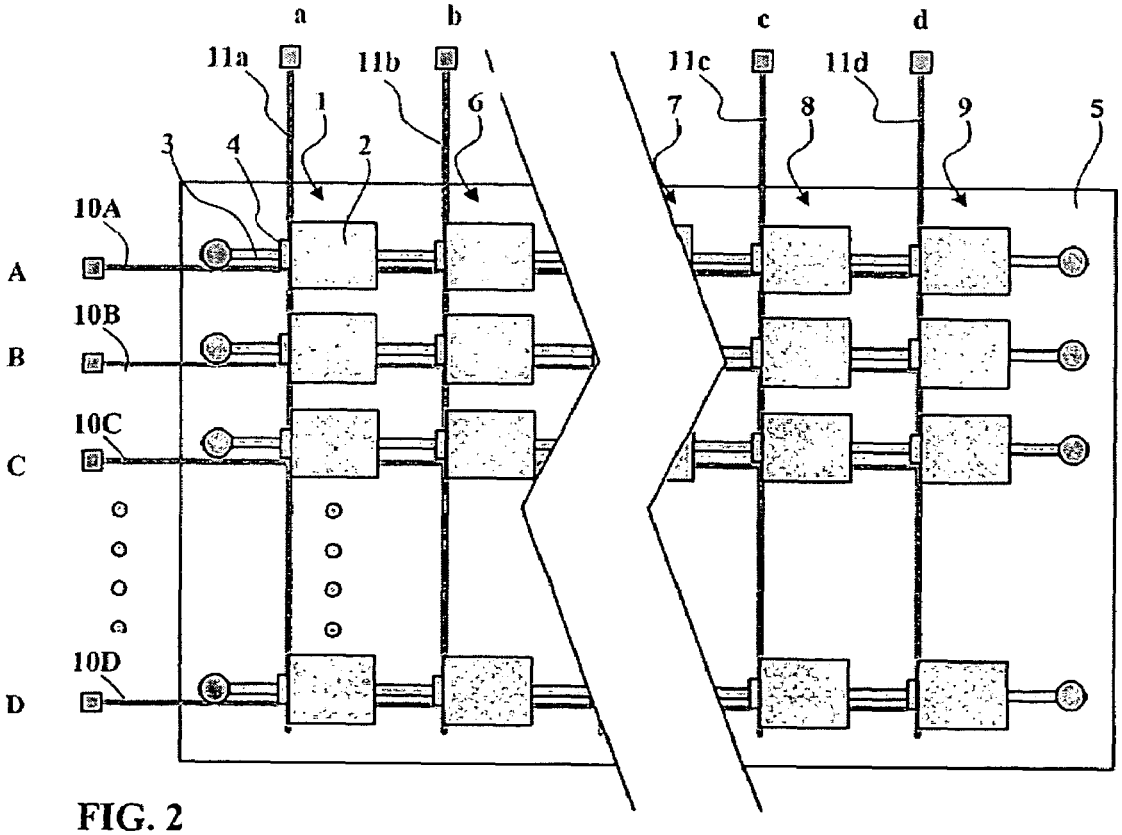
FIG. 2 shows a larger array of micropumps disposed in a matrix configuration on a common substrate.

FIG. 2 shows a larger array of micropumps, made in a common semiconductor substrate 5, by etching the appropriate number of associated cavities and channels with the corresponding heater element being placed at the appropriate locations, i.e. adjacent to the inlets of the cavities such as the cavity 2.

There can thus be seen the micropump 1 constituted by the cavity 2, the channel 3, and the heater element 4.

In the substrate 5, there is an array of micropumps occupying a multiplicity of rows A, B, C, . . . , D, each constituted by a series of a plurality of individual micropumps such as the micropumps 1, 6, 7, 8, and 9 in row A, thereby also constituting columns a, b, . . . , c, and d.

Each row A, B, C, . . . , D is associated with a respective row control conductor 10A, 10B, 10C, . . . , 10D. each column a, b, . . . , c, d is associated with a respective column control conductor 11*a*, 11*b*, . . . , 11*c*, 11*d*.

Each heater element such as the heater element 4 of the micropump 1 situated at the intersection of row A and column a is controlled by simultaneous activation of the corresponding row control conductor 10A and column control conductor 11*a*.

Preferably, the row control conductors 10A, 10B, 10C, . . . , 10D are accessible for connection purposes along a first edge of the substrate 5. Similarly, the column control conductors 11*a*, 11*b*, . . . , 11*c*, and 11*d*, are accessible for connection along a second edge of the substrate 5.

A control device (not shown in the figures) is suitable for selectively powering the row control conductors 10A, 10B, 10C, . . . , 10D, and the column control conductors 11*a*, 11*b*, . . . , 11*c*, and 11*d* so as to enable the heater elements situated at the intersections between the rows and the columns to be controlled at will. This makes it possible to control each individual micropump individually so as to give the array of micropumps desired properties in terms of compression ratio and pumping speed or flow rate.

It is possible to envisage multiplexed control of the heater elements, e.g. by associating each heater element such as the heater element 4 with an electronic bistable circuit which is caused to change state by applying pulses simultaneously to the row control conductor 10A and to the column control conductor 11*a*. The bistable then causes the heater element 4 to be powered electrically from an external source of electricity.

Figure 3:
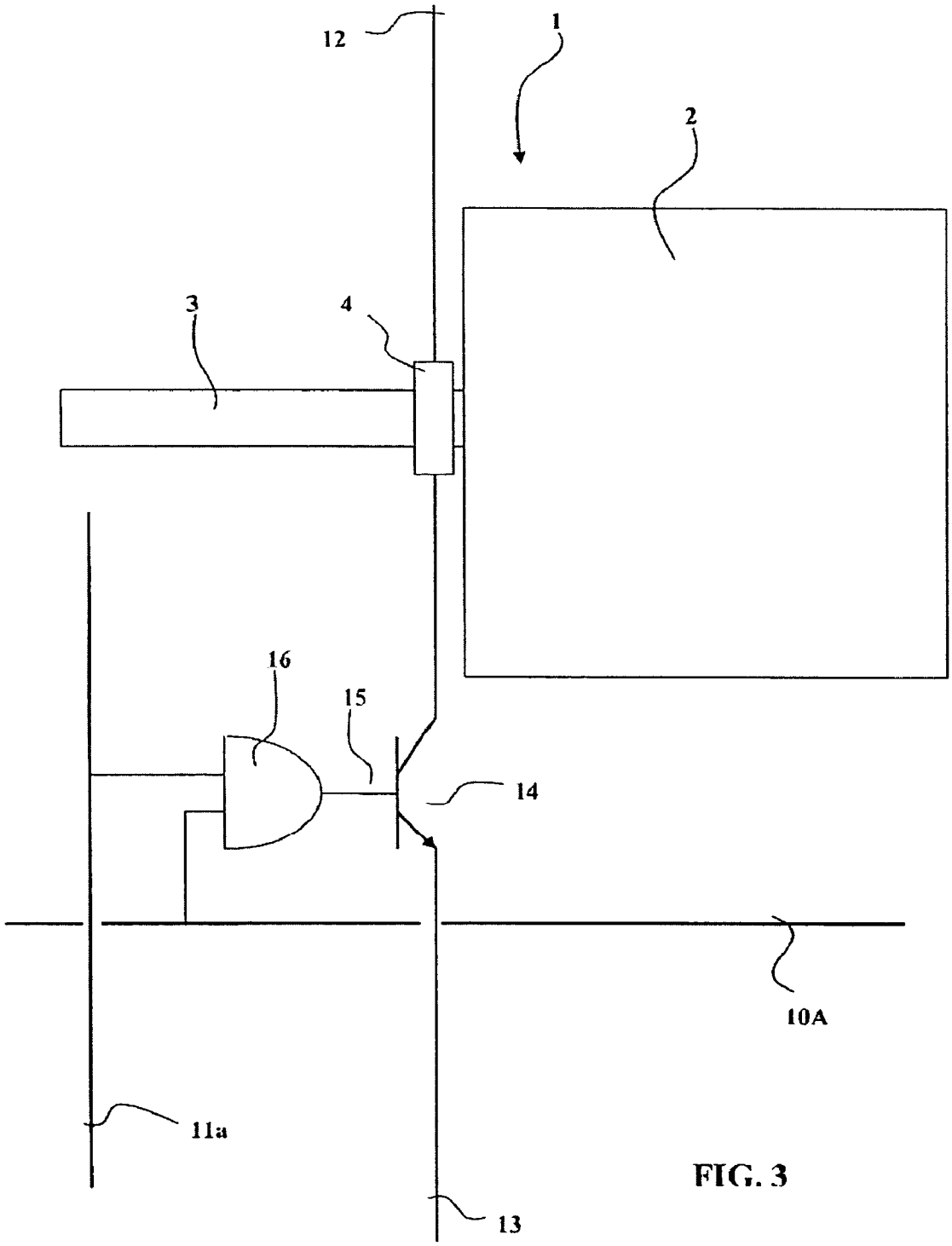
FIG. 3 shows a possible embodiment of control for electrical resistance heater elements for matrix control in an array of the kind shown in FIG. 2.

A simplified method of control is shown in FIG. 3. In this case, the heater element 4 is connected between the positive and negative terminals 12 and 13 of an electrical power supply in series with a transistor 14 whose base 15 is connected to the output of an AND gate 16 having its two inputs connected respectively to the row control conductor 10A and to the column control conductor 11*a*. The transistor 14 becomes conductive for powering the heater element 4 when both of the row and column control conductors 10A and 11*a* are simultaneously at a suitable potential for causing the AND gate 16 to change state and switch ON the transistor 14.

The above description with reference to FIGS. 1 to 3 relates to the control means that enable an array of numerous individual thermal transpiration micropumps to be controlled in a manner that is simple and effective.

Reference is now made to FIGS. 4 to 7 which show means for improving the effectiveness of the individual micropumps.

Figure 4:
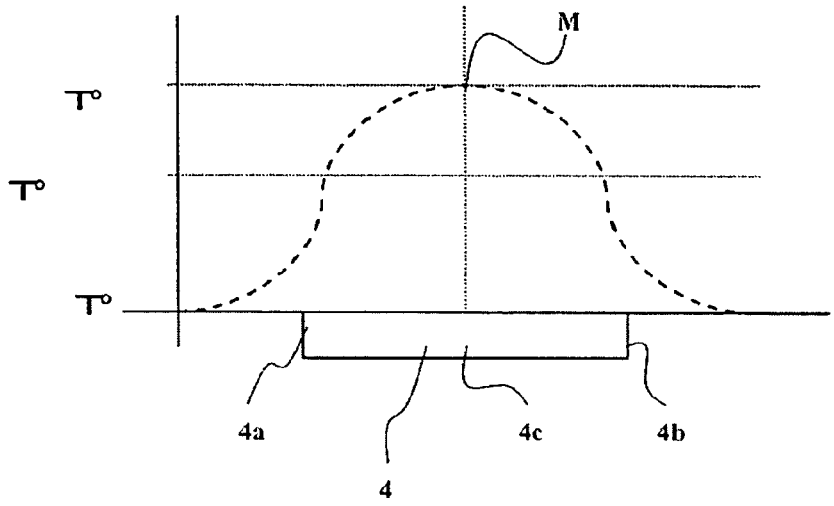
FIG. 4 shows a sinusoidal distribution of temperature along a channel segment heated by a rectangular bar of resistive material.

FIG. 4 shows the distribution of temperature in a hot source for a thermal transpiration micropump constituted by a rectangular resistive bar 4. The dashed line curve plots temperature variation up the ordinate as a function of longitudinal position measured along the length of the channel and plotted along the abscissa.

It can be seen that the temperature varies as a function of the zone under consideration of the bar of resistive material along the channel 3 (FIG. 1): temperature is not uniform but presents a sinusoidal distribution, with a slow increase in the vicinity of the upstream end 4*a* of the bar 4, followed by a rapid increase up to a maximum M in the center 4*c* of the bar 4, followed by a rapid decrease, itself followed by a more progressive decrease in the vicinity of the downstream end 4*b* of the bar 4.

This sinusoidal temperature distribution is the result specifically of a generally unequal distribution of the electrical current which travels along the bar 4 in a direction generally perpendicular to the longitudinal axis of the channel. The electric current seeks to travel along the shortest possible path in order to go from one terminal to the other, and the shortest path passes essentially through the center 4*c* of the bar 4, thereby maximizing the central temperature at the maximum M.

In contrast, this traditional structure for the rectangular bar produces a temperature that is relatively low in the vicinity of the downstream end 4*b* of the bar 4, which is the end closest to the following cavity 2.

Unfortunately, an important factor for obtaining maximum compression ratio for a thermal transpiration pump lies in the ratio between the temperature at the downstream end of the channel 3 (i.e. the inlet orifice into the cavity 2) and the temperature within the cavity 2. It can thus be understood that the rectangular section resistive bar of the heater element 4 shown in FIG. 4 does not enable an optimum temperature ratio to be obtained, which then requires the temperature at the maximum M in the center 4*c* of the bar to be increased excessively.

The idea of the invention is then to modify the distribution of temperature along the heater element so that the temperature in the vicinity of the downstream end 4*b* of the heater element is hardly any less than the temperature in the central portion and in the other portions of the heater element. This should enable the heater element to produce a higher temperature in the vicinity of the downstream end of the channel 3 without requiring a corresponding temperature increase in the other portions of the heater element. Electricity consumption can thus be minimized, and it is possible to avoid running the risk of degrading elements by having an excessive temperature in the center of the heater element.

Figure 5:
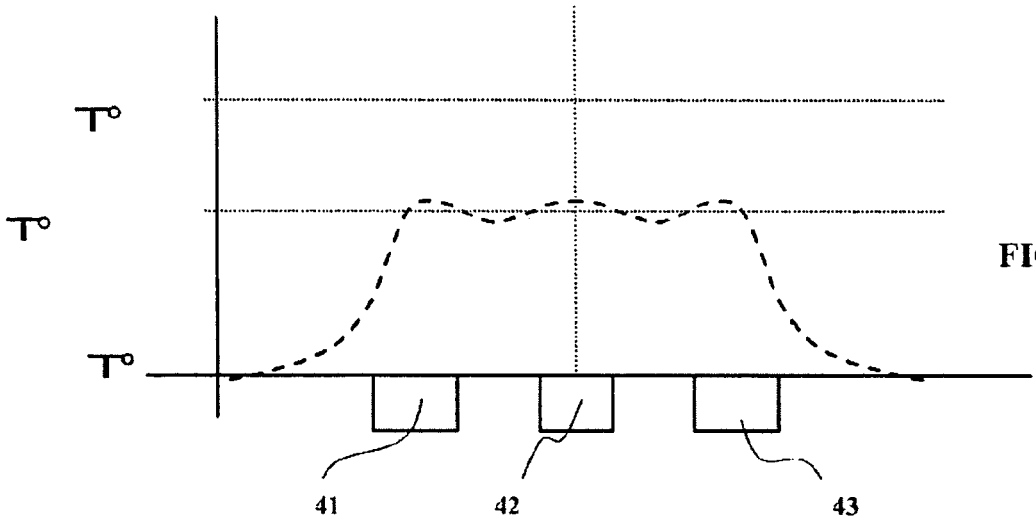
FIG. 5 shows the temperature distribution for a hot source having a structure in the form of three parallel bars.

A first embodiment is shown in FIG. 5 in which the heater element is formed by three successive heater elements 41, 42, 43 placed across the channel 3 and offset longitudinally along the channel. FIG. 5 shows the distribution of temperature in the presence of the three heater elements 41, 42, and 43. It can be seen that temperature is more regular as a function of the longitudinal zone under consideration of the channel. A variant may consist in providing only two heater elements, providing a shorter heater segment in the channel 3.

Figure 6:
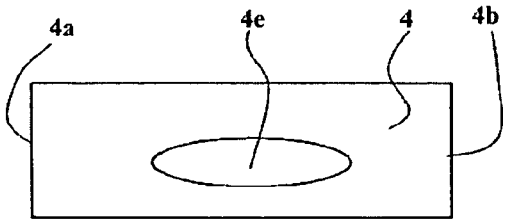
FIG. 6 shows another form of hot source comprising a rectangular bar with a central recess.

FIG. 6 shows another embodiment of the heater element 4 that includes a central cavity 4*e* that does not have any resistive element, thus encouraging electricity to pass in the vicinity to the upstream and downstream ends 4*a* and 4*b* of the heater element 4. This reduces the temperature reached in the center of the heater element 4.

Figure 7:
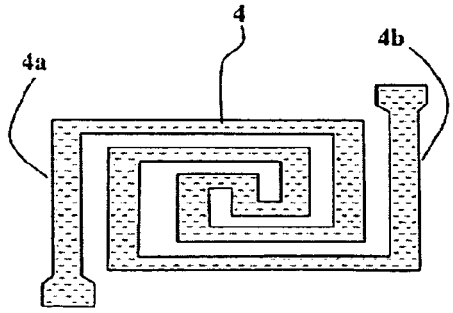
FIG. 7 shows another hot source structure in the form of a heater track, wound as a flat double spiral.

FIG. 7 shows another embodiment of the heater element 4, which is constituted by a strip of resistive material wound to form a flat double spiral strip. This avoids encouraging electricity to pass through the center of the heater element 4, thereby reducing the overheating effect in the center of the heater element 4.

In all of these embodiments, the heater element 4 is required to produce heating over a sufficient length of the channel 3 to ensure satisfactory contact with the molecules of gas passing through the channel. It is necessary for the heater element 4 to be able to heat sufficient molecules for them to become agitated and present the appropriate high temperature prior to entering into the following cavity 2. That is why the heater element 4 cannot itself be of short length and concentrated in the immediate vicinity of the inlet orifice to the cavity 2, but on the contrary it is necessary for it to be extended upstream along the channel 3 in order to achieve a length that is sufficient.

In the above description, the heater element 4 is described as being an electrical-resistance.

Alternatively, the heater element 4 could be the hot portion of a Peltier effect couple, while the cooling element of the Peltier effect couple is placed in register with the cavity 2 of the micropump, or in register with the upstream portion of the channel 3.

The description below refers to FIGS. 8 to 12 which show means for reducing the overall volume of the pumping apparatus made up of thermal transpiration micropumps.

Figure 8:
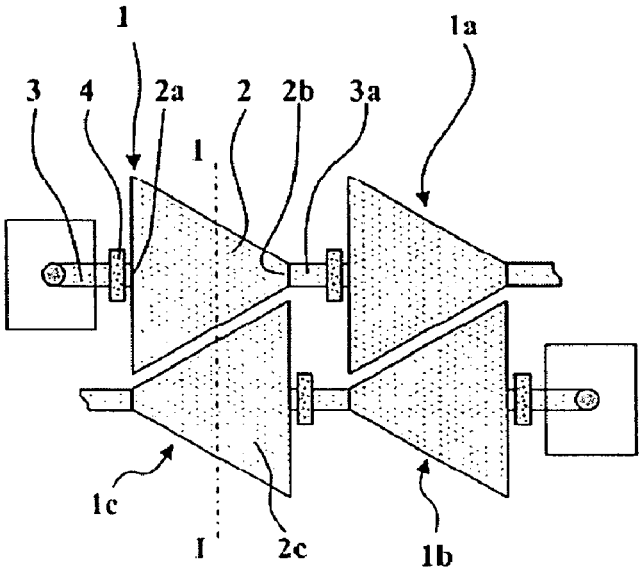
FIG. 8 shows an embodiment in which the cavities are of constant thickness but of width that tapers from their inlets towards their outlets, and disposed in opposite directions.

FIG. 8 shows a first embodiment in which the cavities are of constant thickness but of width that decreases going from their inlets towards their outlets. This figure thus shows four individual micropumps 1, 1*a*, 1*b*, and 1*c* each having, as in the embodiment of FIG. 1, a cavity 2, an inlet channel 3, a heater element 4, and an outlet channel 3*a*, the cavity being connected to two respective channels via its inlet 2*a* and its outlet 2*b*.

Figure 9:
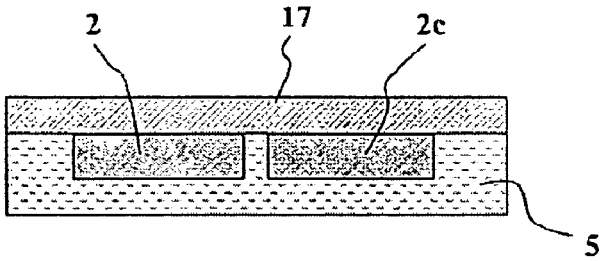
FIG. 9 shows the cavities of FIG. 1 seen in vertical section on plane I-I of FIG. 8.

FIG. 9 shows the set of micropumps of FIG. 8 seen in section on plane I-I. In these two figures there can be seen the two cavities 2 and 2*c* disposed side by side.

As can be seen better in FIG. 9, the cavities 2 and 2*c* are made by etching in a substrate 5, and the cavities are then closed by a glass plate 17 fitted onto the etched substrate 5. In this embodiment, the cavities 2 and 2*c* are of constant thickness.

As can be seen in FIG. 8, in this embodiment the cavities such as the cavity 2 are of a width that decreases going from their inlet 2*a* towards their outlet 2*b*. The progressive reduction in width may be regular so as to form a cavity 2 that is generally triangular as shown in FIG. 8. It is possible to adopt such a shape for the cavity 2 because the temperature of the gas decreases progressively going from the inlet 2*a* of the cavity 2 towards the outlet 2*b* of the same cavity 2, with that causing the mean free path length of the molecules to decrease simultaneously, such that the width of the cavity 2 remains, at any longitudinal position under consideration, considerable greater than the mean free path length of the molecules, thus ensuring that the molecules travel within the cavity 2 under viscous medium movement conditions.

FIG. 8 shows that the cavities 2 and 2*c* are interleaved facing in opposite directions which means that given their triangular shape the amount of space they occupy overall is reduced in the cross-section direction.

Figure 10:
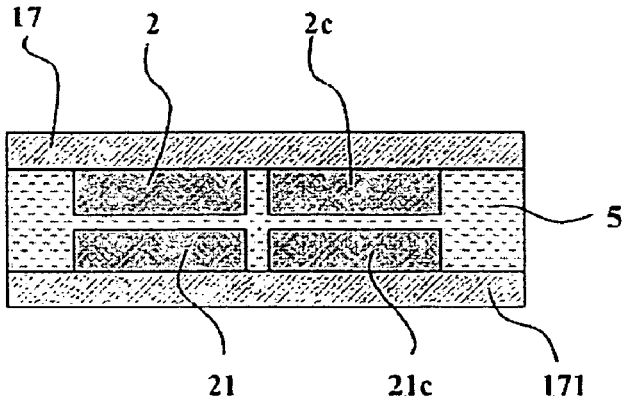
FIG. 10 is a vertical section showing an embodiment of a substrate processed on both faces in order to implement two layers of cavities.

FIG. 10 is a cross-section showing an improvement of the above-described embodiment. In this improvement, the substrate 5 is etched in both of its opposite faces so as to constitute in a first face the above-described cavities 2 and 2*c* and to constitute in its opposite face two cavities 21 and 21*c*. The two faces are closed by respective glass plates 17 and 171. This doubles the number of individual micropumps per unit area of substrate 5.

Nevertheless, this embodiment leads to the overall thickness of the apparatus being increased.

Figure 11:
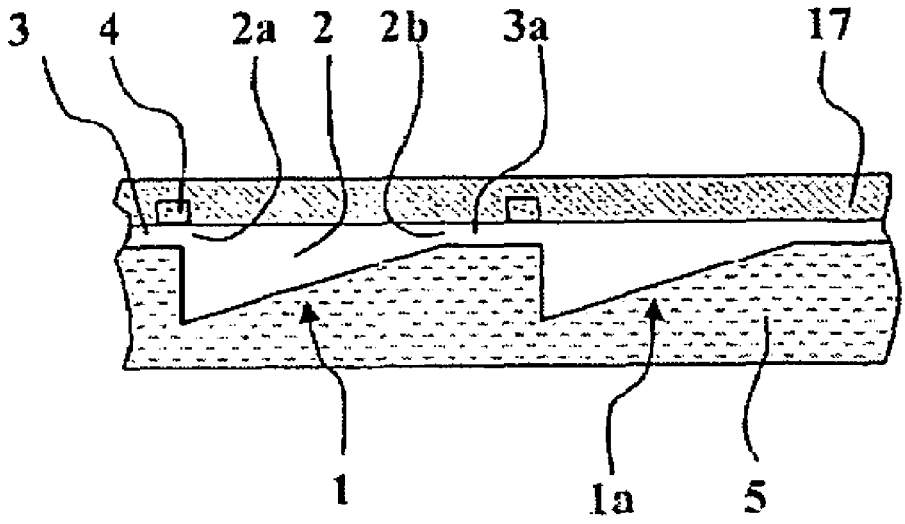
FIG. 11 shows another embodiment in which the depth of the cavities varies regularly, decreasing going from their inlets towards their outlets.

The embodiment shown in FIG. 11 which is in longitudinal section consists in modifying not the width of the cavity but its depth so as to provide a cavity 2 of varying cross-section.

Thus, the figure shows a cavity 2 constituted by etching a substrate 5 and covered by a glass plate 17, with the depth of the cavity tapering going away from its inlet 2*a* towards its outlet 2*b*. This figure also shows the inlet channel 3 and the outlet channel 3*a*. There can also be seen the heater element 4.

Figure 12:
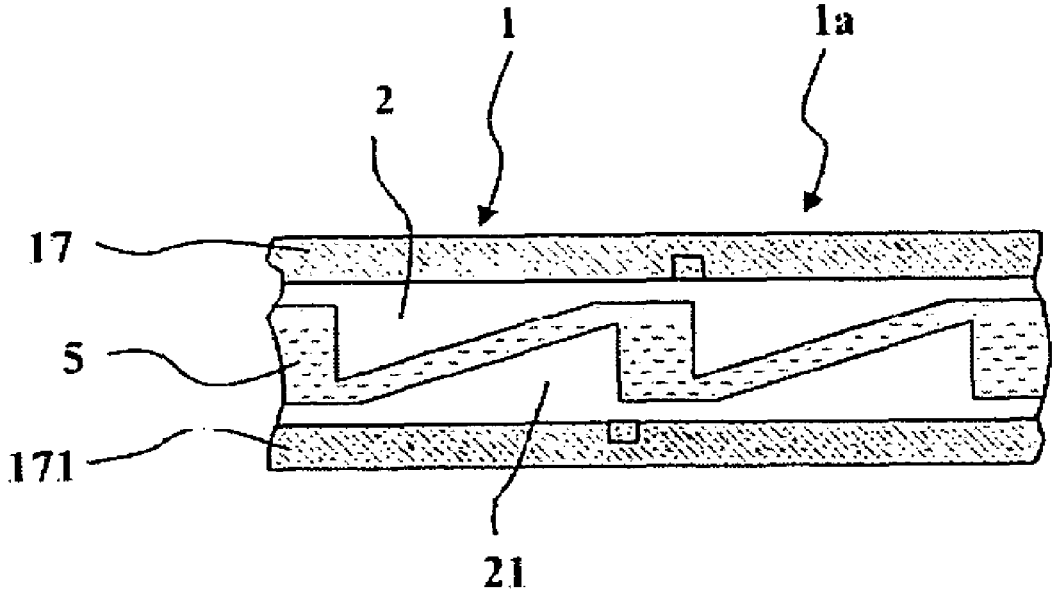
FIG. 12 shows one possible way of interfitting two layers of cavities of varying depth.

Finally, FIG. 12 shows an embodiment which combines the idea of varying depth as shown in FIG. 11 for individual micropumps 1 and la in series, with the idea of superposing two layers as shown in FIG. 10 in a substrate 5 that is etched in both faces and that is engaged between two glass plates 17 and 171, and also the idea of interleaving cavities as shown in FIG. 8. Thus, the cavities 2 and 21 are interleaved in opposite directions, thereby reducing the overall thickness of the assembly compared with the embodiment shown in FIG. 10.

Because the cavities are interleaved in this way, cavity density is increased, i.e. the number of individual micropumps per given area of substrate 5 is increased, and also the number of micropumps in a given volume of substrate 5 is increased. The number of micropumps can be increased by a factor that is close to 4, thereby leading to a proportional increase in pumping speed.

The present invention is not limited to the embodiments described explicitly above, and it includes the generalizations and variants that are within the competence of the person skilled in the art.

The invention claimed is:

1. Pumping apparatus using thermal transpiration micropumps, each thermal transpiration micropump comprising at least one cavity having an inlet connected to an inlet channel of small cross-section and having an outlet connected to an outlet channel, and including a heater element for heating the segment of the inlet channel that is adjacent to the cavity, a plurality of such micropumps being connected in series, the apparatus being characterized in that:

the micropumps are distributed on a substrate in a plurality of rows each made up of a plurality of micropumps, thereby building up a plurality of columns; and the respective heater elements of the micropumps are each controlled by appropriately controlling a row control conductor and a column control conductor.

2. Pumping apparatus according to claim 1, characterized in that the row control conductors are accessible for electrical connection along a first edge of the substrate, and the column control conductors are accessible for electrical connection along a second edge of the substrate.

3. Pumping apparatus according to claim 1, characterized in that the control means control the row control conductors and the column control conductors selectively so as to control each individual micropump individually in the array of micropumps.

4. Pumping apparatus according to claim 1, characterized in that each heater element is of the electrical resistance type, being connected to the terminals of an electrical power supply in series with a transistor, itself controlled by an AND gate having inputs connected respectively to a corresponding row control conductor and to a corresponding column control conductor.

5. Pumping apparatus according to claim 1, characterized in that each heater element is controlled by a bistable, itself arranged to change state on simultaneously receiving control pulse signals coming from a corresponding row control conductor and from a corresponding column control conductor.

6. Pumping apparatus according to claim 1, characterized in that one or more rows of micropumps are connected in series to constitute a series subassembly, a plurality of series subassemblies being connected in parallel.

7. Pumping apparatus according to claim 1, characterized in that at least some of the micropumps have a cavity of section that tapers from the inlet towards the outlet, and in that cavities of similar shapes are interleaved in opposite directions so as to reduce the amount of space they occupy in common in cross-section.

8. Pumping apparatus according to claim 7, characterized in that the cross-section of the cavity at all points under consideration along its length remains sufficiently large to ensure that the gas molecules move under viscous medium conditions.

9. Pumping apparatus according to claim 7, characterized in that the cavities are of constant thickness and of width that decreases from their inlets towards their outlets, the cavities being interleaved side by side in opposite directions so as to reduce the overall space they occupy in the transverse direction.

10. Pumping apparatus according to claim 1, wherein the heating element heats molecules of gas to a predetermined temperature prior to the molecules of gas entering the cavity.

11. Pumping apparatus according to claim 10, wherein the heating element is extended in an upstream direction from each of the at least one cavity.

* * * * *

UNITED STATES PATENT AND TRADEMARK OFFICE

CERTIFICATE OF CORRECTION

PATENT NO. : 7,572,110 B2
APPLICATION NO. : 10/979149
DATED : August 11, 2009
INVENTOR(S) : Bernard et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 935 days.

Signed and Sealed this

Fourteenth Day of December, 2010

David J. Kappos

David J. Kappos
*Director of the United States Patent and Trademark Office*